US005885000A

United States Patent [19]

Miyahara et al.

[11] Patent Number: 5,885,000

[45] Date of Patent: Mar. 23, 1999

[54] SINGLE-PIECE CONTACTOR SHAFT ASSEMBLY

[75] Inventors: Todd M. Miyahara, Wahiawa; Timothy A. Potter, Kapolei, both of Hi.

[73] Assignee: Chevron U.S.A. Inc., San Francisco, Calif.

Related U.S. Application Data

[60] Provisional application No. 60/031,653 Nov. 19, 1996.

[21] Appl. No.: 915,239

[22] Filed: Aug. 20, 1997

[51] Int. Cl.[6] ..... B01F 7/00

[52] U.S. Cl. ..... 366/251; 366/331

[58] Field of Search ..... 366/242–251, 366/262–266, 286, 314, 331, 608

[56] References Cited

U.S. PATENT DOCUMENTS

| | | | |
|---|---|---|---|
| 2,746,779 | 5/1956 | Lobanoff | 366/331 |
| 3,606,260 | 9/1971 | Rubin | 366/331 |
| 3,887,169 | 6/1975 | Maynard | 366/331 |
| 4,511,255 | 4/1985 | Saucier | 366/286 |
| 5,368,390 | 11/1994 | Gambrill et al. | 366/331 |
| 5,700,086 | 12/1997 | Forslund | 366/331 |

FOREIGN PATENT DOCUMENTS

| | | | |
|---|---|---|---|
| 216294 | 7/1961 | Austria | 366/331 |

*Primary Examiner*—Charles E. Cooley
*Attorney, Agent, or Firm*—Timothy J. Hadlock

[57] ABSTRACT

The invention includes a hydraulic head and contactor shaft assembly combination for attachment to a fluid-containing vessel and motor including: a hydraulic head for removable attachment to one end of a vessel and having a circular aperture in the center; a bearing housing having an open-end and a closed-end. The open-end is fixedly attached to the hydraulic head and the closed-end has a circular aperture. The center axis of the circular aperture in the closed-end of the bearing housing is aligned with the center axis of the circular aperture. There is a single-piece contactor shaft having a first end and a second end. The first end protrudes through the circular aperture in the hydraulic head. A first annular passageway is formed between the single-piece contactor shaft aperture. The first end is configured for removable attachment to a rotatable mixing blade and the second end protrudes through the circular aperture in the closed-end of the bearing housing, forming a second annular passageway between the single-piece contactor shaft aperture in the closed-end of the bearing housing. The second end of the single-piece contactor shaft is configured for removable attachment to a rotatable motor shaft. There is a doughnut-shaped seal for preventing passage of the liquids through the first annular passageway. The doughnut-shaped seal is positioned in the first annular passageway. There is a doughnut-shaped bearing for supporting the single-piece contactor shaft. The doughnut-shaped bearing is positioned in the second annular passageway. A rotatable mixing blade is removably attached to the first end of the single-piece contactor shaft.

15 Claims, 2 Drawing Sheets

SINGLE-PIECE CONTACTOR SHAFT ASSEMBLY

CROSS-REFERENCE TO RELATED APPLICATIONS

This application claims priority from U.S. Provisional Application Ser. No. 60/031,653, filed Nov. 19, 1996.

I. FIELD OF THE INVENTION

The present invention relates to a single-piece contactor shaft assembly and method of using it to mix fluids.

II. BACKGROUND OF THE INVENTION

Chemical process units such as alkylation units require introduction of two liquid reactants and mixture of those reactants. Mixture is facilitated generally by an impeller blade. In known assemblies, the impeller blade is driven by a two-piece drive shaft. The impeller is situated in a removable end portion of the reactor on one end of the alkylation unit. Persons skilled in the art sometimes call this portion of the reactor a "hydraulic head." The two-piece drive shaft is disposed through an aperture in the hydraulic head and connected on one end to the impeller blade and on the other end to, e.g., an electric motor.

The liquid reactants, e.g., in an alkylation unit, pose environmental and safety hazards and therefore it is desirable to avoid leakage of the liquids out of the reactor. The drive shaft disposed through an aperture in the hydraulic head therefore must utilize a seal (a "mechanical seal") at the location where the drive shaft meets the aperture. The mechanical seal is necessary to keep the products and reactants from leaking out of the reactor. The mechanical seal typically includes integral bearing for supporting the drive shaft.

A second weight-supporting bearing is used to support the two-piece drive shaft. The second weight-supporting bearing is located along the two-piece drive shaft at a point between the aperture in the hydraulic head and the motor shaft.

This mechanical seal has a limited life and must be replaced and/or maintained from time-to-time. Such maintenance and/or replacement requires shutting down the process unit.

In theory, the advantage of the existing two-piece drive shaft (also referred to as a "split drive shaft") is that it allows on-site maintenance and/or replacement of the mechanical seal. This is done by detaching the motor shaft coupling and the split shaft coupling. The split shaft coupling is typically accessed by an access door in the bearing housing. The bearing housing is detached from the hydraulic head. The oil seal and bearing housing remain attached to one portion of the split drive shaft. The oil seal and bearing housing cannot be removed in the field from its associated piece of the split drive shaft. These detachments result in access to the mechanical seal for maintenance/replacement. In the absence of a split drive shaft, the procedure would have to be as follows. The motor shaft is disconnected, the hydraulic head is disconnected, and the whole assembly is brought into a repair facility for removal of the oil seal. Only then is the mechanical seal accessible for maintenance/replacement.

The disadvantage of the two-piece drive shaft, however, is that upon reinstallation of the bearing housing, the connection point of the two portions of the two-piece drive shaft must be precisely aligned within narrow tolerances. Any misalignment results in wobble, vibration, and the resulting stress forces to the assembly. Such forces result in premature and possibly catastrophic outage of the contactor assembly. The precise alignment necessary to avoid these premature outages is manpower intensive and requires 6–8 hours to complete. In practice, the theoretical advantage of maintaining the mechanical seal is not possible. This is due to the great difficulty of sufficiently aligning the two-piece drive shaft in the field. In practice, adequate alignment is only possible in the shop. This necessitates removal of the hydraulic head, thus negating the intended advantages of the two-piece drive shaft.

It would be desirable to have a contactor assembly which did not have the deficiencies of requiring precise alignment on installation. Accordingly, the contactor assembly of the invention provides a solution to this problem. It has now been discovered that a contactor assembly having a one-piece drive shaft avoids the deficiencies of the existing two-piece drive shaft.

II. SUMMARY OF THE INVENTION

The invention includes a hydraulic head and contactor shaft assembly combination for attachment to a fluid-containing vessel and motor means including:

(a) a hydraulic head member for removably attachment to one end portion of a vessel; the hydraulic head member having a substantially circular aperture in a central portion therein;

(b) a bearing housing having an open-end portion and a closed-end portion:
- i) where the open-end portion is fixedly attached to the hydraulic head member; and where the closed-end portion has a substantially circular aperture therein; and
- ii) where the center axis of the circular aperture in the closed-end portion of the bearing housing is substantially aligned with the center axis of the circular aperture in the hydraulic head member;

(c) a single-piece contactor shaft having a first end portion and a second portion:
- i) where the first end portion of the single-piece contactor shaft is disposed through, and protrudes through, the circular aperture in the hydraulic head member, whereby a first annular passageway is formed between the single-piece contactor shaft and portions of the hydraulic head member defining the aperture in the hydraulic head member;
- ii) where the first end portion is configured for removable attachment to a rotatable mixing blade member; and
- iii) where the second end portion of the single-piece contactor shaft is disposed through, and protrudes through, the circular aperture in the closed-end portion of the bearing housing, whereby a second annular passageway is formed between the single-piece contactor shaft and portions of the bearing housing defining the aperture in the closed-end portion of the bearing housing;
- iv) where the second end portion of the single-piece contactor shaft is configured for removable attachment to a rotatable motor shaft member;

(d) a substantially doughnut-shaped seal member for preventing passage of the liquids through the first annular passageway, where the doughnut-shaped seal member is disposed in the first annular passageway;

(e) a substantially doughnut-shaped bearing member for supporting the single-piece contactor shaft, where the doughnut-shaped bearing member is disposed in the second annular passageway;

(f) a rotatable mixing blade member having a substantially radially symmetrical configuration and having a substantially centrally located aperture therein:

i) where the rotatable mixing blade is removably attached to the first end portion of the single-piece contactor shaft; and ii) where the single-piece contactor shaft is disposed in the aperture in the mixing blade.

The invention also includes a method of mixing fluids as described below:

(a) providing a hydraulic head and contactor shaft assembly combination as described above;

(b) introducing into the hydraulic head member at least two fluids;

(c) mixing the fluids by:

i) thereby rotating the single-piece contactor shaft; and ii) thereby rotating the rotatable mixing blade member.

IV. BRIEF DESCRIPTION OF THE DRAWING

V. DETAILED DESCRIPTION OF THE PREFERRED EMBODIMENTS

A. Elements

Figure 1:
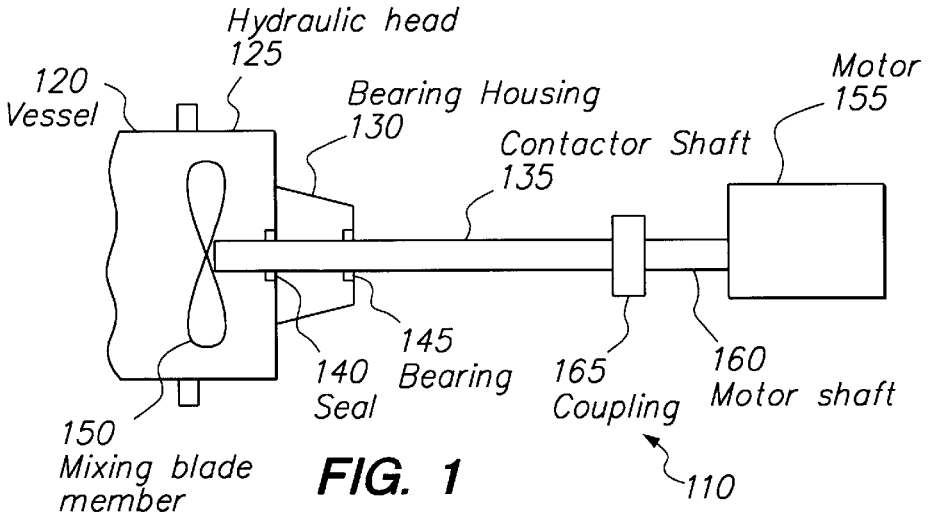
FIG. 1 depicts in one embodiment, a side cross-sectional schematic view of the contactor assembly of the invention.

The elements for the assembly and corresponding reference numbers are listed in Table 1 below. In the section following this one, each element and how it relates to the other elements is described in detail with reference to the figures. The reference numbers were selected so that the first digit corresponds to the first figure in which the element clearly appears. For example, mixing blade member 150 first appears in FIG. 1. Although the mixing blade member appears in FIG. 4 also, it is numbered 150 in FIG. 4 too since it is the same element.

TABLE 1

| Element Name | Element Number Used In FIGS. |
|---|---|
| A reaction vessel. | 120 |
| A hydraulic head member. | 125 |
| A bearing housing. | 130 |
| A single-piece contactor shaft. | 135 |
| A substantially doughnut-shaped seal member. | 140 |
| A substantially doughnut-shaped bearing assembly. | 145 |
| A motor shaft coupling | 165 |
| A rotatable mixing blade member. | 150 |
| An electric motor. | 155 |
| A motor shaft | 160 |

B. Organization of Elements of the Alkylation Reactor and Contactor Shaft Assembly The invention includes a contactor shaft assembly combination for mixing fluids in a vessel. Typically, the vessel is a reaction vessel. That is, the purpose of mixing the fluids is to facilitate their reaction into a desired product. In one embodiment of the invention, the vessel is an alkylation reactor vessel 120 for mixing liquid butane and sulfuric acid and for reaction to produce product alkylate. One such commercially available alkylation reactor is the Stratco brand Type H alkylation reactor. Optionally, the reaction vessel 120 has an elongated shape. Vessel 120 has two end portions.

There is a hydraulic head member 125. It is for removable attachment to one end portion of vessel 120 and it is adapted for fluid communication with vessel 120. Hydraulic head member 125 has a substantially circular aperture in a central portion therein. The center axis of the circular aperture is substantially parallel with the longitudinal axis of the elongated alkylation vessel 120. The hydraulic head member is optionally bell shaped having one open end and one closed end. The closed end has the circular aperture in a central portion therein and the open end is for attachment to the vessel 120. The open end typically has about the same diameter as the open end portion of the vessel 120 to which it is to be attached. In that sense, the hydraulic head member 125 is like a removable end portion of the vessel. Attachment of hydraulic head member 125 to vessel 120 is by any conventional means such as bolting. The attachment is made substantially leak proof by using conventional sealant means such as gaskets.

The assembly of the invention includes a bearing housing 130. Optionally, bearing housing 130 is substantially bell-shaped. It has an open-end portion and a closed-end portion. The open-end portion typically has a smaller diameter than the diameter of the vessel 120. The open-end portion, in one embodiment, is fixedly attached to closed-end portion hydraulic head member 125. Preferably, the attachment of the bearing housing is to an outer portion of the closed-end portion of the hydraulic head. That is, the attached to the end portion of the hydraulic head member 125 having the circular aperture.

As with the hydraulic head member, the closed-end portion of the bearing housing 130 has a substantially circular aperture therein. The center axis of the circular aperture in the closed-end portion of the bearing housing 130 is substantially aligned with the center axis of the circular aperture in the hydraulic head member 125. By substantially aligned, it is meant that a single straight line could pass through the center of both apertures and that the line would maintain a substantially 90 degree angle between all parts of the planes in which circle defined by the apertures lie.

As with attachment of hydraulic head member 125 to vessel 120, attachment of bearing housing 130 to hydraulic head member 125 by conventional attachment means and the attachment is made substantially leak proof by conventional means. An enclosure is formed by the inner surfaces of the bearing housing 130 and the exterior surface portions of the hydraulic head member 125 to which it is attached. The enclosure is typically used as a reservoir for containing lubricating oil for lubricating the bearing assembly 145 and/or seal 140, each discussed below. An example of a suitable lubricating oil is ROYCO 782. Any leakage of fluids from vessel 120 through seal 140, discussed below, is also contained in this enclosure. The reservoir is also optionally pressurized with an inert gas to assist in preventing seal leakage.

The key element of the invention is a single-piece contactor shaft 135. It typically is an elongated rigid structure having a substantially cylindrical shape. It has a first end portion and a second end portion. The first end portion of the single-piece contactor shaft 135 is disposed through, and protrudes through, the circular aperture in the hydraulic head member 125. This results in formation of a first annular passageway formed between the single-piece contactor shaft 135 and portions of the hydraulic head member 125 defining the aperture. The first end portion is configured for receipt of a rotatable mixing blade member 150.

The second end portion of the single-piece contactor shaft 135 is disposed through, and protrudes through, the circular aperture in the closed-end portion of the bearing housing 130. This results in a second annular passageway between the single-piece contactor shaft 135 and portions of the bearing housing 130 defining the aperture in the closed-end portion of the bearing housing 130. The second end portion of the single-piece contactor shaft 135 is configured for attachment to a rotatable motor shaft member 160.

There is a substantially doughnut-shaped mechanical seal member 140 for preventing passage of the mixing liquids, e.g., liquid butane and the sulfuric acid, and any reactant product, e.g., alkylate, through the first annular passageway. The doughnut-shaped mechanical seal member 140 is disposed in the first annular passageway. Attachment of the seal member 140 is by conventional means. An example of suitable seals are BW tandem seal with an API plan 32 and API plan 53.

The invention includes a substantially doughnut-shaped bearing assembly 145 for supporting the single-piece contactor shaft 135. The doughnut-shaped bearing assembly 145 is disposed in the second annular passageway. Attachment of the bearing assembly 145 to the bearing housing 130 is by conventional means. Examples of suitable bearing assemblies are Timken bearings.

Removably attached to the first end portion of the single-piece contactor shaft 135 is rotatable mixing blade member 150. It typically has a substantially radially symmetrical configuration. It has a substantially centrally located aperture. The single-piece contactor shaft 135 is disposed in the aperture in the mixing blade. Typically, an impeller type assembly is preferred.

A motor member 155 generates a rotational force for driving the single-piece contactor shaft assembly. Typically, an electric motor 155 is used. The electric motor 155 included a rotatable motor shaft member 160 for transmitting a rotational force. The elongated motor shaft has an end portion removably attached to the second end portion of the single-piece contactor shaft 135. Attachment is by any conventional coupling means such a sleeve coupling and key way or by bolting.

The alkylation reactor and contactor shaft assembly combination is configured so that during operation of the alkylation reactor and contactor shaft assembly combination the following occurs: Rotation of the motor shaft drives rotation of the single-piece contactor shaft 135. This, in turn, causes rotation of the single-piece contactor shaft 135 which drives rotation of the mixing blade. As a result, rotation of the mixing blade causes mixing of the mixing fluids, e.g., liquid butane and the sulfuric acid.

C. Dimensions

The main dimensions of some embodiments of the assembly of the invention are shown in Table 2 below.

TABLE 2

| | Broader | Narrower |
|---|---|---|
| Contactor Shaft 135: | | |
| Length (inches) | 40–70 | 51–61 |
| Diameter (inches) | 2–8 | 2–4 |
| Mixing Blade 150 Diameter (inches) | 20–100 | 25–40 |
| Vessel 120 (feet) | 15–55 | 30–40 |
| Hydraulic Head 125: | | |
| Diameter (inches) | 20–100 | 25–40 |
| Length (inches) | 15–35 | 21–31 |
| Bearing Housing 130: | | |
| Diameter (inches) | 8–50 | 8–16 |
| Length (inches) | 10–40 | 15–25 |

D. Benefits of the Invention

Figure 2:
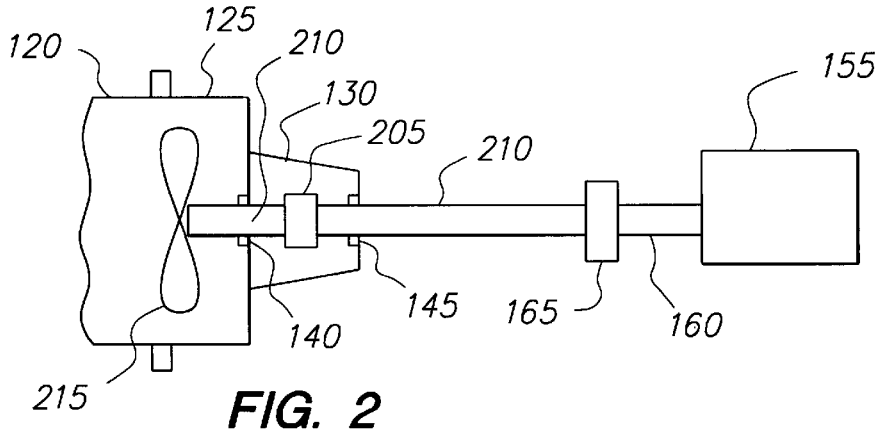
FIG. 2 PRIOR ART
FIG. 2 depicts a side cross-sectional schematic view of a known contactor assembly having a two-piece contactor shaft.
Figure 3:
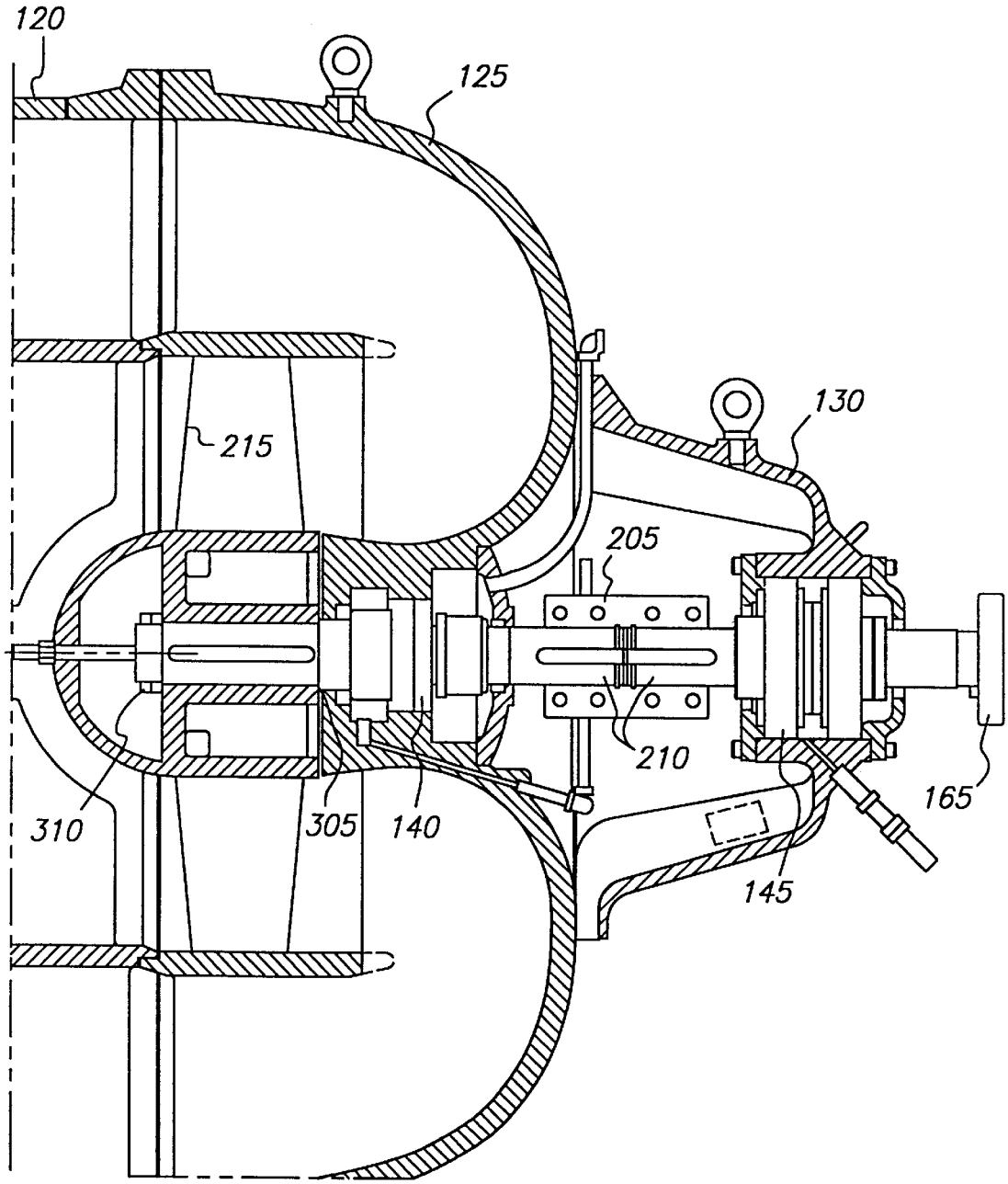
FIG. 3 PRIOR ART
FIG. 3 depicts a side cross-sectional detailed schematic view of a known contactor assembly having a two-piece contactor shaft.

FIGS. 2 and 3 depict a side cross-sectional view of a two-piece contactor shaft assembly that is known. As shown, two-piece contactor shaft 210 is coupled by split coupling 205. As discussed in the background section above, there are significant disadvantages of a two-piece contactor shaft. The two portions of the shaft must be aligned within very strict tolerances. If those tolerances are not met, wobble can result in frequent seal maintenance or even catastrophic failure. This is due to the large rotational forces caused by the high speed rotations of the shaft. To properly align the two-piece shaft is a very time consuming and manpower intensive exercise. Thus, eliminating the two-piece shaft and substituting it with a single-piece shaft saves time, manpower, and reduces seal maintenance and the risk of catastrophic failure of the assembly.

In this known contactor assembly, as in the invention, one end of the contactor shaft is disposed in a central aperture of the impeller. The design of the mixing blade assembly 150 of the invention is different from the design of the impeller 215 in the known two-piece contactor assembly. In that assembly, the impeller 215 rests against a shoulder 305 on the end portion of the two-piece contactor shaft 210. The shoulder 305 is of a larger diameter than the aperture in the impeller 215 and therefore prevents the impeller from sliding farther down the two-piece contactor shaft 210. Locking nut 310 threadably attaches to the end of the shaft to keep the blade member attached thereto.

Figure 4:
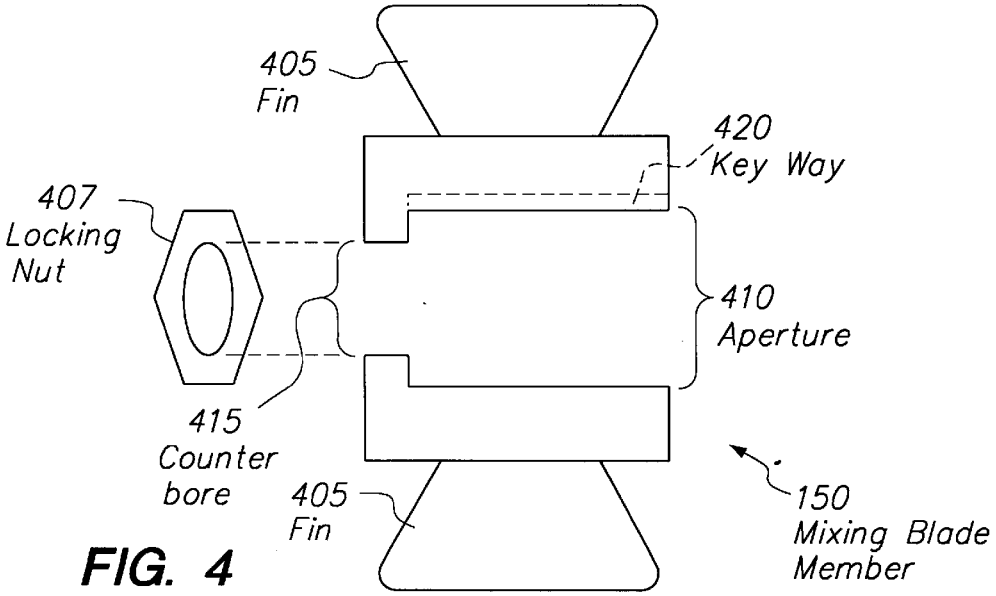
FIG. 4 depicts in one embodiment, a side cross-sectional schematic view of the mixing blade member of the contactor assembly of the invention.

In contrast, as shown in FIG. 4, the mixing blade member 150 of the invention, has a counterbore 415 of smaller diameter than the aperture 410 of the mixing blade member 150 having multiple fin members 405 fixedly attached thereto. This prevents the mixing blade member 150 from sliding farther down the single-piece contactor shaft 135. Typically, the extreme end portion of the single-piece contactor shaft is threaded about its outer circumference. A locking nut 407 is then threaded onto this threaded portion of the single-piece contactor shaft 135 to hold the mixing blade member 150 in place. It is typically necessary to insure the mixing blade member 150 rotates at the same rate as the single-piece contactor shaft 135. That is, to insure there is no slipping. To accomplish this, typically, a key way 420 runs along the inner surface of the aperture in the mixing blade member 150 and is aligned with a second key way (not shown) along the outer surface of the first end portion of the single-piece contactor shaft 135. An elongated "key" (not shown), typically a rigid metal member, is then disposed in both key ways.

E. Method Aspect of the Invention

The invention also includes a method of mixing fluids. The method of the invention requires providing a hydraulic head and contactor shaft assembly combination as described in the apparatus of the invention above. The next step is introducing into the hydraulic head member 125 at least two fluids. The fluids are then mixed by operation of the apparatus of the invention. That is, the mixing is achieved by rotating the single-piece contactor shaft 135 and thereby rotating the rotatable mixing blade member 150. A mixture of the fluids or any reactant product thereof is optionally recovered from the vessel 120.

Process conditions and parameters necessary for practicing alkylation of liquid butane and sulfuric acid are conventional. Process conditions for other types of mixing and/or reacting processes used in the method of the invention are specific to those processes are known to those skilled in the art.

What is claimed is:

1. An alkylation reactor and contactor shaft assembly combination for mixing fluids comprising:

(a) an elongated alkylation reaction vessel for mixing liquid butane and sulfuric acid and containing the reactant product alkylate;

(b) a hydraulic head member, having an open-end portion and a closed-end portion, removably attached to an end portion of said vessel and in fluid communication with said vessel:

i) wherein said hydraulic head member having a substantially circular aperture in a central portion therein; and ii) wherein the center axis of said circular aperture is substantially parallel with the longitudinal axis of said elongated alkylation vessel;

(c) a substantially bell-shaped bearing housing having an open-end portion and a closed-end portion, said open-end portion having a larger diameter than said closed-end portion;

i) wherein the open-end portion is fixedly attached to an outer portion of said closed-end portion of said hydraulic head member;

ii) wherein the closed-end portion has a substantially circular aperture therein; and iii) wherein the center axis of said circular aperture in the closed-end portion of said bearing housing is substantially aligned with the center axis of said circular aperture in said hydraulic head member;

(d) a single-piece contactor shaft having a substantially cylindrical shape and having a first end portion and a second end portion:

i) wherein said single-piece contactor shaft is from about 51 inches to about 61 inches in length and from about 2 inches to about 4 inches in diameter;

ii) wherein the first end portion of said single-piece contactor shaft is disposed through, and protrudes through, said circular aperture in said hydraulic head member, whereby a first annular passageway is formed between said single-piece contractor shaft and portions of said hydraulic head member defining said aperture;

iii) wherein said first end portion is configured for receipt of a rotatable mixing blade member;

iv) wherein the second end portion of said single-piece contactor shaft is disposed through, and protrudes through, said circular aperture in said closed-end portion of said bearing housing, whereby a second annular passageway is formed between said single-piece contactor shaft and portions of said bearing housing defining said aperture in said closed-end portion of said bearing housing; and v) wherein the second end portion of said single-piece contactor shaft is configured for attachment to a rotatable motor shaft member;

(e) a substantially doughnut-shaped mechanical seal member for preventing passage of the liquid butane and the sulfuric acid and the reactant product alkylate through said first annular passageway, wherein said doughnut-shaped mechanical seal member is disposed in said first annular passageway;

(f) a substantially doughnut-shaped support bearing assembly for supporting said single-piece contactor shaft, wherein said doughnut-shaped support bearing assembly is disposed in said second annular passageway;

(g) a rotatable mixing blade member having a substantially radially symmetrical configuration and having a substantially centrally located aperture:

i) wherein said rotatable mixing blade member is removably attached to said first end portion of said single-piece contactor shaft; and ii) wherein said single-piece contactor shaft is disposed in said aperture in said mixing blade member;

(h) an electric motor for generating a rotational force for driving said single-piece contactor shaft assembly:

i) said electric motor comprising a rotatable motor shaft member for transmitting a rotational force; and ii) wherein said motor shaft member has an end portion removably attached to said second end portion of said single-piece contactor shaft; and (i) wherein said alkylation reactor and contactor shaft assembly combination is configured so that during operation of said alkylatlon reactor and contactor shaft assembly combination:

i) whereby rotation of said motor shaft member drives rotation of said single-piece contactor shaft;

ii) whereby rotation of said single-piece contactor shaft drives rotation of said mixing blade member; and iii) whereby rotation of said mixing blade member causes mixing of said liquid butane and said sulfuric acid.

2. A hydraulic head and contactor shaft assembly combination for attachment to a fluid-containing vessel and motor means comprising:

(a) a hydraulic head member, having an open-end portion and a closed-end portion, for removable attachment to one end portion of a vessel; said hydraulic head member having a substantially circular aperture in a central portion therein;

(b) a substantially bell-shaped bearing housing having an open-end portion and a closed-end portion, said open-end portion having a larger diameter than said closed-end portion:

i) wherein the open-end portion is fixedly attached to an outer portion of said closed-end portion of said hydraulic head member; and wherein the closed-end portion has a substantially circular aperture therein; and ii) wherein the center axis of said circular aperture in the closed-end portion of said bearing housing is substantially aligned with the center axis of said circular aperture in said hydraulic head member;

(c) a single-piece contactor shaft having a first end portion and a second portion:

i) wherein the first end portion of said single-piece contactor shaft is disposed through, and protrudes through, said circular aperture in said hydraulic head member, whereby a first annular passageway is formed between said single-piece contactor shaft and portions of said hydraulic head member defining said aperture in said hydraulic head member;

ii) wherein said first end portion is configured for removable attachment to a rotatable mixing blade member; and iii) wherein the second end portion of said single-piece contactor shaft is disposed through, and protrudes through, said circular aperture in said closed-end portion of said bearing housing, whereby a second annular passageway is formed between said single-place contactor shaft and portions of said bearing housing defining said aperture in said closed-end portion of said bearing housing;

iv) wherein the second end portion of said single-piece contractor shaft is configured for removable attachment to a rotatable motor shaft member;

(d) a substantially doughnut-shaped seal member for preventing passage of said fluid contained in said vessel through said first annular passageway, wherein said doughnut-shaped seal member is disposed in said first annular passageway;

(e) a substantially doughnut-shaped bearing member for supporting said single-piece contactor shaft, wherein said doughnut-shaped bearing member is disposed in said second annular passageway;

(f) a rotatable mixing blade member having a substantially radially symmetrical configuration and having a substantially centrally located aperture therein:

i) wherein said rotatable mixing blade member is removably attached to said first end portion of said single-piece contactor shaft; and ii) wherein said single-piece contactor shaft is disposed in said aperture in said mixing blade member.

3. The hydraulic head and contactor shaft assembly combination of claim 2, wherein said bearing housing is substantially bell-shaped.

4. The hydraulic head and contactor shaft assembly combination of claim 2:

(a) further comprising an elongated alkylatlon reaction vessel for mixing liquid butane and sulfuric acid and containing the reactant product alkylate; and (b) wherein said hydraulic head member is removably attached to, and in fluid communication with, an end portion of said elongated alkylation reaction vessel.

5. The hydraulic head and contactor shaft assembly combination of claim 2, further comprising an electric motor for generating a rotational force for driving said single-piece contactor shaft assembly:

(a) wherein said electric motor comprises a rotatable motor shaft member for transmitting said rotational force; and (b) wherein said motor shaft member has an end portion removably attached to said second end portion of said single-piece contactor shaft.

6. The hydraulic head and contactor shaft assembly combination of claim 5, wherein said rotatable mixing blade member consists essentially of an impeller assembly.

7. The hydraulic head and contactor shaft assembly combination of claim 6, wherein said impeller assembly has a diameter from about 30 inches to about 40 inches.

8. The hydraulic head and contactor shaft assembly combination of claim 2, wherein said doughnut-shaped seal member consists essentially of a mechanical seal assembly.

9. The hydraulic head and contactor shaft assembly combination of claim 8, wherein said doughnut-shaped bearing member comprises a support bearing.

10. The hydraulic head and contactor shaft assembly combination of claim 2, wherein said single-piece contactor shaft is from about 40 inches to about 70 inches in length and from about 2 inches to about 8 inches in diameter.

11. The hydraulic head and contactor shaft assembly combination of claim 10, wherein said bearing housing is from about 8 inches to about 16 inches in diameter and from about 10 inches to about 40 inches in length.

12. A hydraulic head and contactor shaft assembly combination for attachment to a fluid-containing vessel and motor means comprising:

(a) a hydraulic head member, having an open-end portion and a closed-end portion, for removably attachment to one end portion of a vessel; said hydraulic head member having a substantially circular aperture in a central portion therein;

(b) a substantially bell-shaped bearing housing having an open-end portion and a closed-end portion, said open-end portion having a larger diameter than said closed-end portion:

i) wherein the open-end portion is fixedly attached to an outer portion of said closed-end portion of said hydraulic head member; and wherein the closed-end portion has a substantially circular aperture therein; and ii) wherein the center axis of said circular aperture in the closed-end portion of said bearing housing is substantially aligned with the center axis of said circular aperture in said hydraulic head member;

(c) a single-piece contactor shaft having a first end portion and a second portion:

i) wherein the first end portion of said single-piece contactor shaft is disposed through, and protrudes through, said circular aperture in said hydraulic head member, whereby a first annular passageway is formed between said single-piece contactor shaft and portions of said hydraulic head member defining said aperture in said hydraulic head member;

ii) wherein said first end portion is configured for removable attachment to a rotatable mixing blade member; and iii) wherein the second end portion of said single-piece contactor shaft is disposed through, and protrudes through, said circular aperture in said closed-end portion of said bearing housing, whereby a second annular passageway is formed between said single-piece contactor shaft and portions of said bearing housing defining said aperture in said closed-end portion of said bearing housing;

iv) wherein the second end portion of said single-piece contactor shaft is configured for removable attachment to a rotatable motor shaft member;

(d) a substantially doughnut-shaped seal member for preventing passage of said fluid contained in said vessel through said first annular passageway, where in said doughnut-shaped seal member is disposed in said first annular passageway;

(e) a substantially doughnut-shaped bearing member for supporting said single-piece contactor shaft, wherein said doughnut-shaped bearing member is disposed in said second annular passageway;

(f) a rotatable mixing blade member having substantially radially symmetrical configuration and having a substantially centrally located aperture therein:

i) wherein said rotatable mixing blade member is removably attached to said first end portion of said single-piece contactor shaft; and ii) wherein said single-piece contactor shaft is disposed in said aperture in said mixing blade member;

iii) wherein said rotatable mixing blade member further comprises a counter-bore defining one side of said aperture in said rotatable mixing blade member;

iv) wherein said counter-bore has a smaller diameter than said aperture; and v) said counter-bore for providing a stopping surface for a locking nut threaded on said first end portion of said one-piece contactor shaft for attaching said one-piece contactor shaft to said rotatable mixing blade member.

13. A method of mixing liquid butane and sulfuric acid for reaction to an alkylate product, said method comprising:

(a) providing an alkylation reactor and contactor shaft assembly combination for mixing fluids comprising:

i) an elongated alkylation reaction vessel for mixing liquid butane and sulfuric acid and containing the reactant product alkylate;

ii) a hydraulic head member, having an open-end portion and a closed-end portion, removably attached to an end portion of said vessel and in fluid communication with said vessel:

a) said hydraulic head member having a substantially circular aperture in a central portion therein; and b) wherein the center axis of said circular aperture is substantially parallel with the longitudinal axis of said elongated alkylation vessel;

iii) a substantially bell-shaped bearing housing having an open-end portion and a closed-end portion, said open-end portion having a larger diameter than said closed-end portion;

a) wherein the open-end portion is fixedly attached to an outer portion of said closed-end portion of said hydraulic head member;

b) wherein the closed-end portion of said bearing housing has a substantially circular aperture therein; and c) wherein the center axis of said circular aperture in the closed-end portion of said bearing housing is substantially aligned with the center axis of said circular aperture in said hydraulic head member;

iv) a single-piece contactor shaft having a substantially cylindrical shape and having a first end portion and a second end portion:

a) wherein the first end portion of said single-piece contactor shaft is disposed through, and protrudes through, said circular aperture in said hydraulic head member; whereby a first annular passageway is formed between said single-piece contactor shaft and portions of said hydraulic head member defining said aperture;

b) wherein said first end portion is configured for receipt of a rotatable mixing blade member;

c) wherein the second end portion of said single-piece contactor shaft is disposed through, and protrudes through, said circular aperture in said closed-end portion of said bearing housing, whereby a second annular passageway is formed between said single-piece contactor shaft and portions of said bearing housing defining said aperture in said closed-end portion of said bearing housing; and d) wherein the second end portion of said single-piece contactor shaft is configured for attachment to a rotatable motor shaft member;

v) a substantially doughnut-shaped mechanical seal member for preventing passage of the liquid butane and the sulfuric acid and the reactant product alkylate through said first annular passageway, wherein said doughnut-shaped mechanical seal member is disposed in said first annular passageway;

vi) a substantially doughnut-shaped bearing assembly for supporting said single-piece contactor shaft, wherein said doughnut-shaped bearing assembly is disposed in said second annular passageway;

vii) a rotatable mixing blade member having a substantially radially symmetrical configuration and having a substantially centrally located aperture:

a) wherein said rotatable mixing blade member is removably attached to said first end portion of said single-piece contactor shaft;

b) wherein said single-piece contactor shaft is disposed in said aperture in said mixing blade member;

c) wherein said rotatable mixing blade member further comprises a counter-bore defining one side of said aperture in said rotatable mixing blade member;

d) wherein said counter-bore has a smaller diameter than said aperture; and e) said counter-bore for providing a stopping surface for a locking nut threaded on said first end portion of said one-piece contactor shaft for attaching said one-piece contactor shaft to said rotatable mixing blade member;

viii) an electric motor for generating a rotational force for driving said single-piece contactor shaft assembly:

a) said electric motor comprising a rotatable motor shaft member for transmitting a rotational force; and b) wherein said motor shaft member has an end portion removably attached to said second end portion of said single-piece contactor shaft;

(b) introducing into said hydraulic head a liquid butane and sulfuric acid; and (c) mixing said liquid butane and said sulfuric acid by:

i) rotating said motor shaft member;

ii) thereby rotating said single-piece contactor shaft; and iii) thereby rotating said mixing blade member.

14. The method of claim 13:

(a) wherein at least a portion of said liquid butane and sulfuric acid react to form an alkylate product; and (b) further comprising recovering said alkylate product.

15. A method of mixing liquid butane and sulfuric acid for reaction to an alkylate product, said method comprising:

(a) providing an alkylation reactor and contactor shaft assembly combination for mixing fluids comprising:

i) an elongated alkylation reaction vessel for mixing liquid butane and sulfuric acid and containing the reactant product alkylate;

ii) a hydraulic head member, having an open-end portion and a closed-end portion, removably attached to an end portion of said vessel and in fluid communication with said vessel:

a) said hydraulic head member having a substantially circular aperture in a central portion therein; and b) wherein the center axis of said circular aperture is substantially parallel with the longtudinal axis of said elongated alkylation vessel;

iii) a substantially bell-shaped bearing housing having an open-end portion and a closed-end portion, said open-end portion having a larger diameter than said closed-end portion;

a) wherein the open-end portion is fixedly attached to said closed-end portion of said hydraulic head member;

b) wherein the closed-end portion has a substantially circular aperture therein; and c) wherein the center axis of said circular aperture in the closed-end portion of said bearing housing is substantially aligned with the center axis of said circular aperture in said hydraulic head member;

iv) a single-piece contactor shaft having a substantially cylindrical shape and having a first end portion and a second end portion:

a) wherein the first end portion of said single-piece contactor shaft is disposed through, and protrudes through, said circular aperture in said hydraulic head member; whereby a first annular passageway is formed between said single-piece contactor shaft and portions of said hydraulic head member defining said aperture;

b) wherein said first end portion is configured for receipt of a rotatable mixing blade member;

c) wherein the second end portion of said single-piece contactor shaft is disposed through, and protrudes through, said circular aperture in said closed-end portion of said bearing housing, whereby a second annular passageway is formed between said single-piece contactor shaft and portions of said bearing housing defining said aperture in said closed-end portion of said bearing housing; and d) wherein the second end portion of said single-piece contactor shaft is configured for attachment to a rotatable motor shaft member;

v) a substantally doughnut-shaped mechanical seal member for preventing passage of the liquid butane and the sulfuric acid and the reactant product alkylate through said first annular passageway, wherein said doughnut-shaped mechanical seal member is disposed in said first annular passageway;

vi) a substantially doughnut-shaped bearing assembly for supporting said single-piece contactor shaft, wherein said doughnut-shaped bearing assembly is disposed in said second annular passageway;

vii) a rotatable mixing blade member having a substantially radially symmetrical configuration and having a substantially centrally located aperture:

a) wherein said rotatable mixing blade member is removably attached to said first end portion of said single-piece contactor shaft;

b) wherein said single-piece contactor shaft is disposed in said aperture in said mixing blade member;

c) wherein said rotatable mixing blade member further comprises a counter-bore defining one side of said aperture in said rotatable mixing blade member;

d) wherein said counter-bore has a smaller diameter than said aperture; and e) said counter-bore for providing a stopping surface for a locking nut threaded on said first end portion of said one-piece contactor shaft for attaching said one-piece contactor shaft to said rotatable mixing blade member;

viii) an electric motor for generating a rotational force for driving said single-piece contactor shaft assembly:

a) said electric motor comprising a rotatable motor shaft member for transmitting a rotational force; and b) wherein said motor shaft member has an end portion removably attached to said second end portion of said single-piece contactor shaft;

(b) introducing into said hydraulic head a liquid butane and sulfuric acid; and (c) mixing said liquid butane and said sulfuric acid by:

i) rotating said motor shaft member;

ii) thereby rotating said single piece contactor shaft; and iii) thereby rotating said mixing blade member.

* * * * *